US010048028B2

(12) United States Patent
Furusho

(10) Patent No.: US 10,048,028 B2
(45) Date of Patent: Aug. 14, 2018

(54) LOW RECOIL FIREARM

(71) Applicant: Akihisa Furusho, Tajimi (JP)

(72) Inventor: Akihisa Furusho, Tajimi (JP)

( * ) Notice: Subject to any disclaimer, the term of this patent is extended or adjusted under 35 U.S.C. 154(b) by 0 days.

(21) Appl. No.: 15/403,175

(22) Filed: Jan. 11, 2017

(65) Prior Publication Data

US 2017/0205165 A1 Jul. 20, 2017

(30) Foreign Application Priority Data

Jan. 20, 2016 (JP) ..... 2016-008701

(51) Int. Cl.

| | |
|---|---|
| ***F41A 5/10*** | (2006.01) |
| ***F41A 25/22*** | (2006.01) |
| ***F41A 25/12*** | (2006.01) |
| ***F41A 9/27*** | (2006.01) |

(52) U.S. Cl.
CPC *F41A 5/10* (2013.01); *F41A 9/27* (2013.01); *F41A 25/12* (2013.01); *F41A 25/22* (2013.01)

(58) Field of Classification Search
CPC .. F41A 5/10; F41A 25/10; F41A 25/12; F41A 25/14; F41A 25/22
USPC ..... 42/1.06; 89/14.3, 37.14, 42.01, 44.01
See application file for complete search history.

(56) References Cited

U.S. PATENT DOCUMENTS 1,059,093 A * 4/1913 Voeller ..... F41A 25/02 89/37.07
3,491,650 A * 1/1970 Rohr ..... F41A 3/78 42/7
4,473,964 A * 10/1984 Straub ..... F41A 25/22 124/68
4,524,671 A * 6/1985 Bender ..... F16C 29/04 384/51
5,798,473 A * 8/1998 Roblyer ..... F41A 21/28 42/75.01
6,196,108 B1 * 3/2001 Murello ..... F41A 25/10 89/198
8,297,174 B1 * 10/2012 Russell ..... F41A 25/12 89/37.14
2010/0011951 A1 * 1/2010 Eaglestone ..... F41A 21/24 89/42.01
2010/0088942 A1 4/2010 Petruj
2015/0377583 A1 12/2015 Furusho

* cited by examiner

*Primary Examiner* — Bret Hayes
(74) *Attorney, Agent, or Firm* — Yokoi & Co., U.S.A.; Toshiyuki Yokoi

(57) ABSTRACT

Because of a clearance between a barrel supporting member and a barrel, a rotational movement of the barrel is not always constant. Thus, trajectory of a bullet is misaligned. A counterweight 40 is located upper than a barrel 10, and rings 61, 62, which are support portions, are located nearer to the counterweight 40 than a gravity center of the barrel 10. Since the barrel 10 is located lower than the counterweight 40 and engaged with a lower surface side of a gear 30, when a bullet is shot and the barrel 10 is moved backward, a force to rotate the barrel 10 itself clockwise is imparted by a circular surface shape of the gear 30. The barrel 10 receives a force to be rotated clockwise from the gravity center position, the ring 61 and the ring 62, and the barrel 10 is in contact with the inner surface of the barrel supporting member 50. Thus, in spite of the existence of the clearance, the barrel 10 is not displaced in the barrel supporting member 50.

20 Claims, 26 Drawing Sheets

LOW RECOIL FIREARM

CROSS-REFERENCES TO RELATED APPLICATIONS

This patent specification is based on Japanese patent application, No. 2016-008701 filed on Jan. 20, 2016 in the Japan Patent Office, the entire contents of which are incorporated by reference herein.

BACKGROUND OF THE INVENTION

1. Field of the Invention

The present invention relates to a low recoil firearm. In particular, the present invention relates to a low coil firearm having a counterweight.

2. Description of the Related Art

In an automatic gun, a barrel and a bolt are moved backward to load the next bullet by using firing gas pressure generated when shooting a bullet. Since large impact is generated when the barrel and the bolt are moved backward, Patent document 1 discloses a gun (low recoil firearm) that reduces the recoil by driving a counterweight in an opposite direction, for example.

The recoil generated when shooting the bullet in the low recoil firearm is shown in FIG. 25 and FIG. 26.

FIG. 25 is a schematic view showing a configuration of a low recoil firearm invented by the inventor of the present invention. FIG. 26 is a schematic view showing a principle of misalignment of the trajectory of the bullet in the low recoil firearm.

A bolt 2 is located on the back side (left side in the figure) of a barrel 1. Immediately after the bullet is shot, the barrel 1 and the bolt 2 are integratedly moved backward by receiving the pressure of the firing gas. A not illustrated rack is formed on an upper surface of the barrel 1 so that the rack is engaged with a gear 3. The gear 3 is rotatably supported at a fixed position. At an upper surface side of the gear 3, the gear 3 is engaged with a not illustrated rack formed on a lower surface of a counterweight 4.

When the barrel 1 and the bolt 2 are moved backward, the gear 3 is rotated clockwise and the counterweight 4 is moved forward. In other words, the recoil generated when the barrel 1 and the bolt 2 are moved backward functions as a power source to drive the counterweight 4 forward. Consequently, the recoil to the holder of the gun is resolved.

The barrel 1 is moved together with the bolt 2 because the discharge of the firing gas should be delayed with respect to the timing of shooting the bullet. Therefore, the firing gas should be sealed in the barrel 1 for a certain period of time. For the certain period of time, although it is short, the barrel 1 should be moved together. For this reason, a barrel supporting member 5 is required to support the barrel 1 itself so as to be movable back and forth. A clearance is required between the barrel supporting member 5 and the barrel 1 so that the barrel 1 is moved smoothly.

In a short-recoil system which is very often used in recent years, the barrel 1 is specified to be tilted when discharging the firing gas after the shooting. In this system, the clearance is relatively large because the barrel 1 should be tilted.

[Patent Document 1] U.S. patent application publication No. 2010/0088942

BRIEF SUMMARY OF THE INVENTION

Although the clearance is necessarily required between the barrel 1 and the barrel supporting member 5, an axial center of the barrel is misaligned when the barrel is tilted in the barrel supporting member by the existence of the clearance. When the barrel 1 is connected to the counterweight 4 via the gear 3 as shown in FIG. 25, although the barrel 1 should be moved straight backward, the barrel 1 itself is rotated clockwise by an angle A as shown in FIG. 26 unless a moving line of the gravity center of the barrel 1 and the center of a rotational axis of the gear 3 cross with each other.

Because of the clearance between the barrel supporting member 5 and the barrel 1, a rotational movement of the barrel 1 is not always constant and the trajectory of the bullet is misaligned.

The present invention prevents the misalignment of the trajectory of the bullet because it often arises in the low recoil firearm. Note that the low recoil firearm is not limited to the automatic gun.

A low recoil firearm of the present invention includes: a chamber member in which a chamber is formed, the chamber member being movable back and forth in an axial center direction; a chamber member supporting member into which the chamber member is inserted so that the chamber member supporting member supports the chamber member to be movable back and forth in the axial center direction; and a counterweight connected to the chamber member, the counterweight being driven in a direction opposite to a movement of the chamber member when a bullet is shot, wherein protruded support portions are formed on the chamber member supporting member or the chamber member so that the chamber member supporting member and the chamber member are in contact with each other from an upper side and from a lower side at different two points in a longitudinal direction of the chamber member.

As an example, the chamber member is a barrel, and the chamber member supporting member is a barrel supporting member.

In the above described configuration, if the explanation is made by using an example, the barrel is inserted into the barrel supporting member so that the barrel supporting member supports the barrel to be movable back and forth in the axial center direction. The counterweight is connected to the barrel, and the counterweight is driven in a direction opposite to a movement of the barrel when a bullet is shot. Since the counterweight is connected to the barrel so as to be driven in the direction opposite to the movement of the barrel, the barrel easily receives a rotational driving force from a connecting mechanism.

On the other hand, in the protruded support portions, the barrel supporting member and the barrel are in contact with each other from an upper side and from a lower side at different two points in a longitudinal direction of the barrel. Since the barrel supporting member is in contact with the barrel from the upper side and from the lower side at different two points in the longitudinal direction, even when the rotational driving force is applied, the barrel is just pressed to the barrel supporting member. Thus, the trajectory of the bullet is hardly misaligned even when the clearance is formed.

As another aspect of the present invention, the protruded support portions can have: a first support point which is protruded so that the barrel supporting member and the barrel are in contact with each other at an opposite side of a relative position of the counterweight with respect to the barrel; and a second support point which is protruded so that the barrel supporting member and the barrel are in contact with each other at a position nearer to a connection point between the barrel and the counterweight than the first support point.

In the above described configuration, when the first support point is protruded so that the barrel supporting member and the barrel are in contact with each other at an opposite side of a relative position of the counterweight with respect to the barrel and the second support point is located at a position nearer to a connection point between the barrel and the counterweight than the first support point, even when a tip of the barrel tries to rotate toward a direction further than the connecting point, the barrel and the barrel supporting member are almost in contact with each other in advance and the barrel is not tilted any more.

Accordingly, when the bullet is shot, the barrel is not tilted and the trajectory of the bullet is hardly misaligned even when the clearance is formed.

As described above, as an example of the configuration for preventing the chamber or the barrel including the chamber from being tilted, the chamber member can have a chamber connecting member which is integrally connected to the chamber, and the chamber connecting member can be inserted into the chamber member supporting member so that the chamber member supporting member supports the chamber connecting member to be movable back and forth in the axial center direction.

Similarly, the chamber member can be a rotating magazine of a rotary gun, and the chamber member supporting member can be a magazine supporting member which supports the rotating magazine to be movable back and forth in the axial center direction.

By using the present invention, even if the clearance is formed between the chamber member supporting member and the chamber, although the clearance is required for the low recoil firearm, the misalignment of the trajectory of the bullet can be prevented when the bullet is shot.

DETAILED DESCRIPTION OF THE INVENTION

Hereafter, embodiments of the present invention will be explained based on the drawings.

Figure 1:
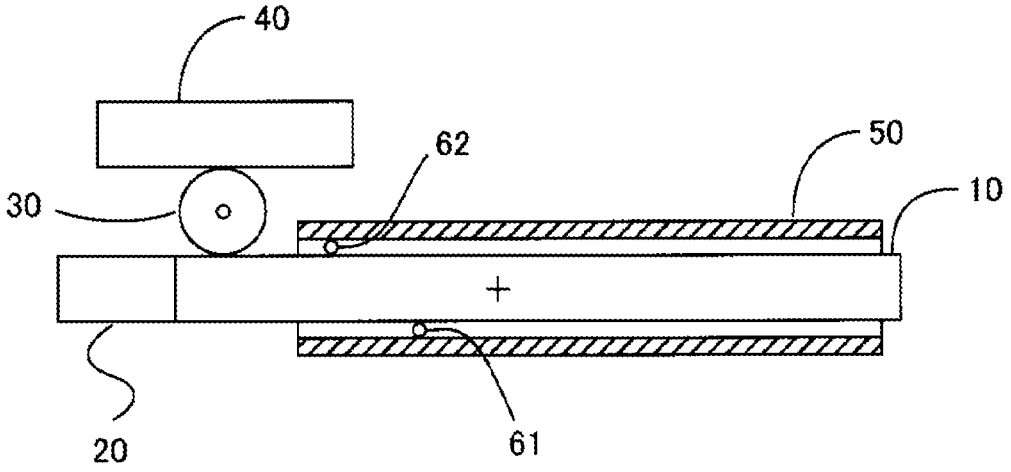
FIG. 1 is a schematic view showing a configuration of a low recoil firearm.

FIG. 1 is a schematic view showing a configuration of a low recoil firearm of one embodiment of the present invention.

In the figure, a bolt 20 is located on the back side (left side in the figure) of a barrel 10. A not illustrated rack is formed on an upper surface of the barrel 10. The rack and a gear 30 are engaged with each other. The gear 30 is rotatably supported at a fixed position. At an upper surface side of the gear 30, the gear 30 is engaged with the not illustrated rack formed on a lower surface of a counterweight 40. A barrel supporting member 50 is formed in a cylindrical shape. The barrel 10 is inserted into the barrel supporting member 50 so that the barrel supporting member 50 supports the barrel 10 to be movable back and forth. For moving the barrel 10 smoothly, a clearance is formed between the barrel supporting member 50 and the barrel 10.

In this example, a chamber is formed at a rear end of the barrel 10. Accordingly, the barrel 10 corresponds to the chamber member, and the barrel supporting member 50 corresponds to the chamber member supporting member because the barrel supporting member 50 supports the barrel 10, which is the chamber member, to be movable in an axial center direction.

The gear 30 functions as a connecting member to transfer a movement of the barrel 10 to a movement of the counterweight 40 in an opposite direction. However, the connecting member is not limited to the above described combination of the gear 30 and the rack. The connecting member can be achieved by connecting the barrel 10 with the counterweight 40 using a belt via a pulley or using a cam, for example. In this example, the surfaces facing each other in the barrel 10 and the counterweight 40 are an upper surface of the barrel 10 and a lower surface of the counterweight 40. The rack and the gear 30 provided on both surfaces are engaged with each other to transfer a movement of one of them to the other while reversing the direction of the movement.

The barrel supporting member 50 is not necessarily formed in a cylindrical shape over whole length. As long as the barrel 10 can be supported to be movable back and forward in the axial center direction, the barrel supporting member 50 can be formed by combining a plurality of semi-elliptical shapes.

Note that the counterweight 40 can be anything as long as it is substantively connected to the chamber member (the barrel 10) to be driven in an opposite direction of the movement of the chamber member when the bullet is shot. This is because the function of the counterweight is performed as long as the anything is connected with the chamber member and driven in an opposite direction of the movement of the chamber member when the bullet is shot and the chamber member is moved even if a main purpose is not for reducing recoil.

Figure 2:
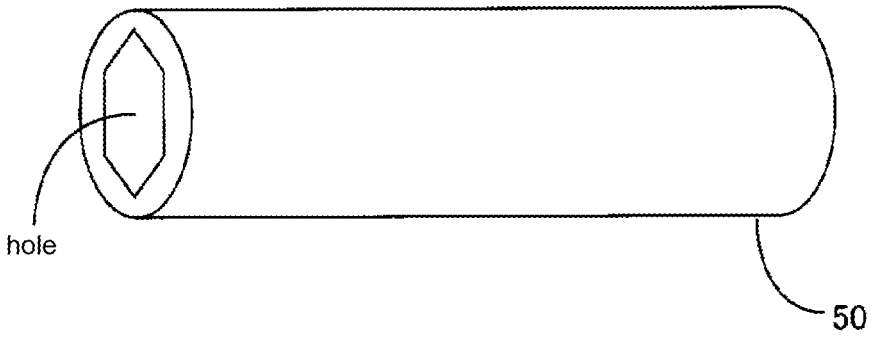
FIG. 2 is a schematic view of a barrel supporting member.
Figure 3:
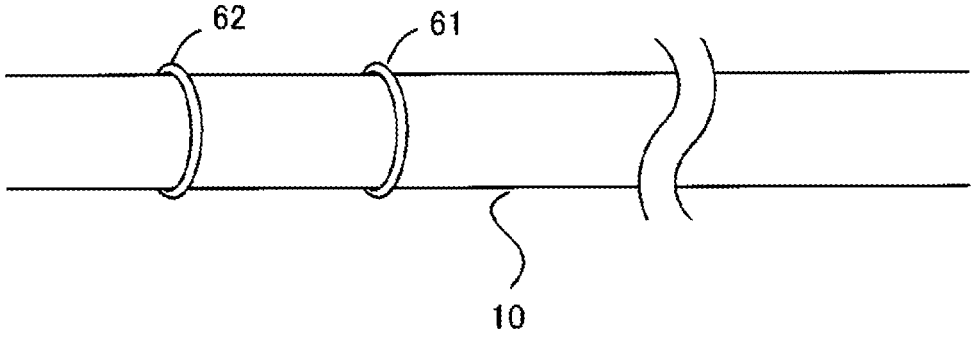
FIG. 3 is a schematic view of a barrel.

FIG. 2 is a schematic view of the barrel supporting member, and FIG. 3 is a schematic view of the barrel.

The barrel supporting member 50 is formed in a hollow cylindrical shape to form a hole having a hexagonal shape in cross-section along the axial center. An outer shape of the barrel 10 is formed in a cylindrical shape. The hole is formed inside the barrel 10 along the axial center so that the hole functions as a trajectory of the bullet. Two rings 61, 62 are mounted on a periphery of the barrel 10 at a predetermined interval with each other. An interval of two facing inner surfaces, which form the hexagonal shape in the barrel supporting member 50, is slightly longer than an outer diameter of the rings 61, 62. Thus, a small clearance is formed between the rings 61, 62 and the inner surfaces.

A pair of apex portions facing to each other in the hexagonal shape are arranged on an upper end and a lower end in the vertical direction. As a result, two inner wall surfaces facing each other in the width direction are vertically arranged, two inner wall surfaces of an upper side form a ceiling surface in a reverse V-shape, and two inner wall surfaces of a lower side form a bottom surface in a V-shape.

Figure 4:
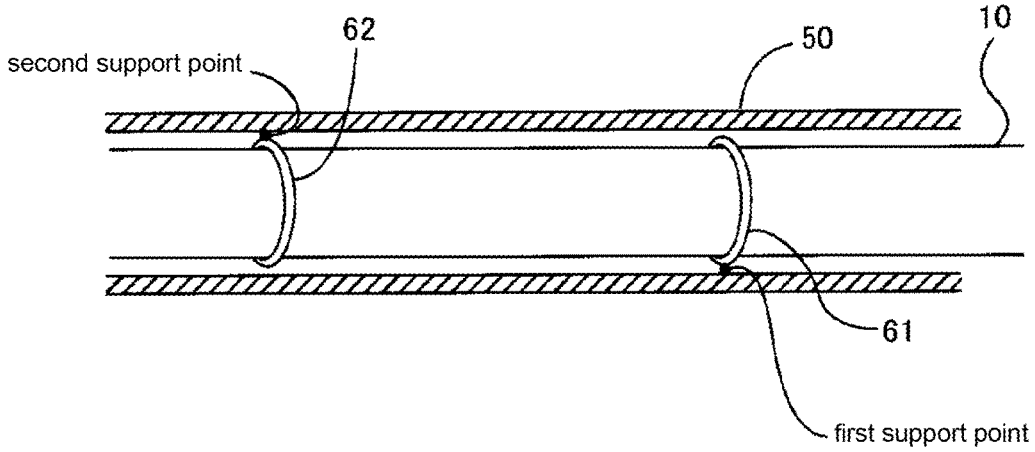
FIG. 4 is a schematic view of the barrel supporting member and the barrel.
Figure 5:
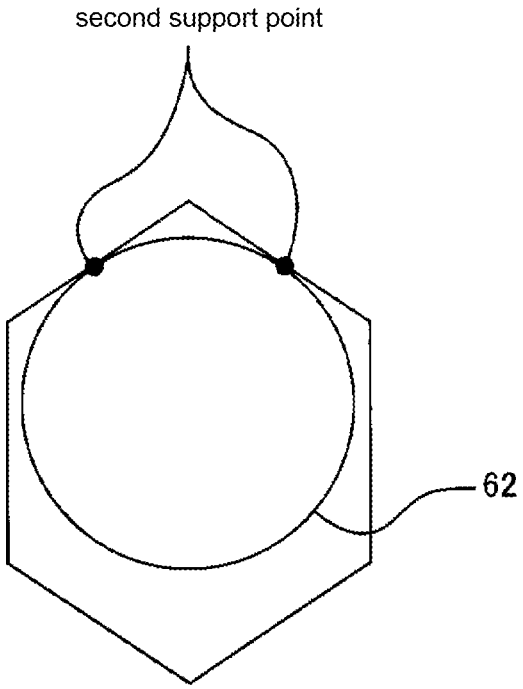
FIG. 5 is a schematic view showing a state of a second support point where the barrel supporting member and the barrel are in contact with each other.
Figure 6:
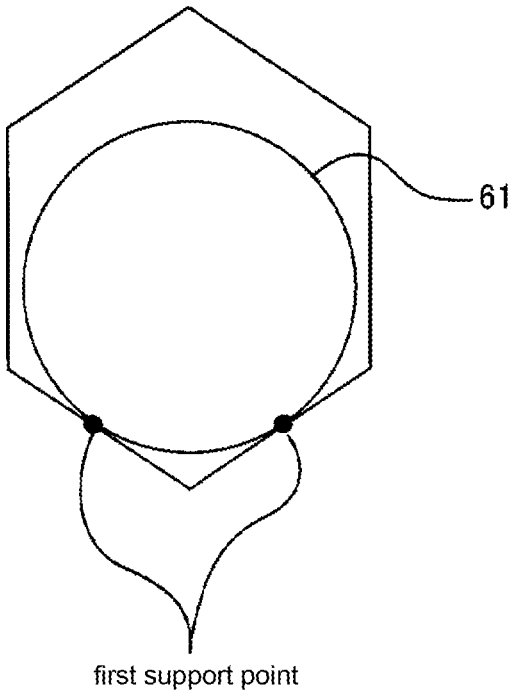
FIG. 6 is a schematic view showing a state of a first support point where the barrel supporting member and the barrel are in contact with each other.

FIG. 4 is a schematic view of the barrel supporting member and the barrel. FIG. 5 is a schematic view showing a state of a second support point where the barrel supporting member and the barrel are in contact with each other. FIG. 6 is a schematic view showing a state of a first support point where the barrel supporting member and the barrel are in contact with each other.

In FIG. 1, a gravity center GC of the barrel 10 is indicated as "+." As shown in FIG. 1, the gravity center of the barrel 10 is located at the tip end side rather than the rings 61, 62. Because of this, the rings 61, 62 receive gravity in a natural condition, and therefore the lower surface of the ring 61 located at the front end side is in contact with the V-shaped bottom surface of the barrel supporting member 50 and the upper surface of the ring 62 located at the rear end side is in contact with the reverse V-shaped ceiling surface of the barrel supporting member 50. Accordingly, a relative position between the barrel 10 and the barrel supporting member 50 is always kept constant without being inclined with respect to the horizontal direction. In other words, in spite of the existence of the clearance between the barrel 10 and the barrel supporting member 50, the direction of the barrel 10 is always kept constant by keeping the barrel supporting member 50 in a stationary state.

Further, since the inner surface of the barrel supporting member 50 is formed in a hexagonal shape and the ring 61 attached to the barrel 10 is pressed to the bottom surface formed in the V-shape, the position of the barrel supporting member 50 is kept constant also in the right and left direction. If the bottom surface is formed in a flat shape, for example, the barrel supporting member 50 can be obliquely moved in the right and left direction. However, by forming the bottom surface in a V-shape, the barrel supporting member 50 can be kept constant. Similarly, since the ceiling surface is formed in a reverse V-shape, the ring 62 is pressed to the ceiling surface and the barrel supporting member 50 is kept constant without being displaced in the right and left direction.

From the above, an inclination angle of the barrel 10 is kept constant in the horizontal direction and in the right and left direction with respect to the barrel supporting member 50.

By the rings 61, 62, the barrel supporting member 50 and the barrel 10 are in contact with other from an upper side and from a lower side at different two points in a longitudinal direction of the barrel 10. Thus, the protruded support portions are formed by the rings 61, 62. The "protruded" means a shape where the outer surface of the barrel 10 and the inner surface of the barrel supporting member 50 are in contact with each other only at a specific portion without being in surface-to-surface contact with each other. The "protruded" includes a shape where a separate member such the rings 61, 62 is interposed between them. Further, the "protruded" includes a shape where one of the barrel 10 and the barrel supporting member 50 is protruded toward the other.

Note that the different two points mean two points with respect to the longitudinal direction of the barrel 10. Thus, even when a plurality of portions are contacted at the same position in the longitudinal direction, it is counted as one point. For example, the barrel 10 and the barrel supporting member 50 are actually in point-contact with each other at two points located at the same position in the longitudinal direction on the second support point as shown in FIG. 5, and the barrel 10 and the barrel supporting member 50 are actually in point-contact with each other at two points located at the same position in the longitudinal direction on the first support point as shown in FIG. 6. Thus, the number of the contact portions is actuary four. However, since each two of them are located at the same position in the longitudinal direction, the two points are not regarded to be located at the different position in the longitudinal direction. Consequently, the second support point shown in FIG. 5 is the first point, and the first support point shown in FIG. 6 is the second point. Thus, "different two points in the longitudinal direction of the barrel 10" are configured.

In addition, since the ring 61 is located at the lower side and the relative position of the counterweight 40 is the upper side with respect to the barrel 10, the ring 61 functions as the first support point which is protruded so that the barrel supporting member 50 and the barrel 10 are in contact with each other at an opposite side of the counterweight 40. Further, since the ring 62 is located at the upper side, the ring 62 functions as the second support point which is protruded so that the barrel supporting member 50 and the barrel 10 are in contact with each other at a position horizontally and vertically nearer to a connection point between the barrel 10 and the counterweight 40 than the ring 61 which is the first support point.

In the present embodiment, the counterweight 40 is located upper than the barrel 10, and the rings 61, 62, which are the supporting portions, are located nearer to the counterweight 40 than a gravity center of the barrel 10. Since the barrel 10 is located lower than the counterweight 40 and engaged with the lower surface side of the gear 30, when the bullet is shot and the barrel 10 is moved backward, a force to rotate the barrel 10 itself clockwise is imparted by a circular surface shape of the gear 30. Namely, a forward force is imparted to the barrel 10. However, the barrel 10 receives a force to be rotated clockwise from the gravity center position, the ring 61 and the ring 62, and the barrel 10 is in contact with the inner surface of the barrel supporting member 50. Thus, in spite of the existence of the clearance, the barrel 10 is not displaced in the barrel supporting member 50. In addition, the inclination angle of the barrel 10 is not inclined with respect to the horizontal direction. The rings 61, 62, which correspond to the protruded support portions, are in contact with the inner surface of the V-shape and the reverse V-shape of the barrel supporting member 50 so that they are in contact with the inner surface at two points in a direction orthogonal to the longitudinal direction of the barrel 10. Accordingly, the barrel 10 is not displaced or rotated in a horizontal plane.

Here, when the protruded support portions are in contact with the chamber member at two points in the longitudinal direction, this means that they are in contact at two points of the above described first support point and second support point. Even when they are in contact at two points on the first support point and at two points on the second support point as shown in the present embodiment, the number of the contact points is not four. The chamber member supporting member and the chamber member are in contact with each other at two different points in the longitudinal direction on the chamber member to prevent the chamber member from being tilted in the chamber member supporting member. Of course, as long as the above described concept is applied, even when the contact points are "three points," the "three points" obviously include "two points."

As explained above, the misalignment of the trajectory of the bullet can be prevented. Note that the barrel 10 can be in point-to-point contact with the barrel supporting member 50 when the protruded support portions are formed by a member having a circular cross-section such as the rings 61, 62. Thus, the friction can be reduced and the position can be kept constant at a fixed position.

In the present embodiment, in addition to the barrel 10 and the barrel supporting member 50, the rings 61, 62 are used. Accordingly, it can be said that the protruded support portions are formed by arranging a separate member between the barrel supporting member 50 and the barrel 10. However, in order to obtain the same function, the protruded support portions can be formed on an inner surface of the barrel supporting member 50 to be protruded toward the barrel 10, or the protruded support portions can be formed on the barrel 10 to be protruded toward the inner surface of the barrel supporting member 50.

Figure 7:
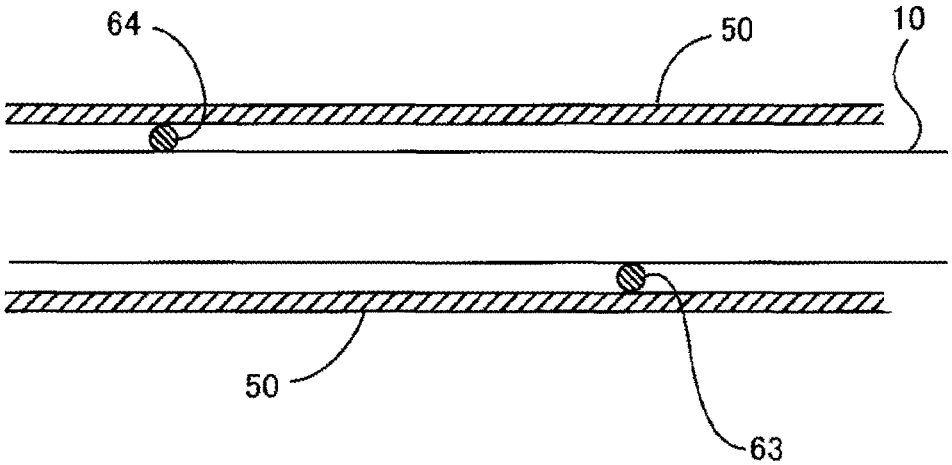
FIG. 7 is a schematic view of the barrel supporting member and the barrel of a variation example.
Figure 8:
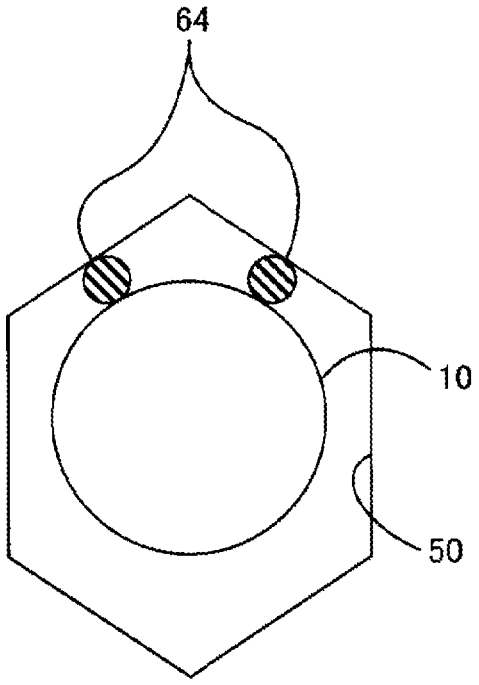
FIG. 8 is a schematic view showing a state of the second support point where the barrel supporting member and the barrel are in contact with each other.
Figure 9:
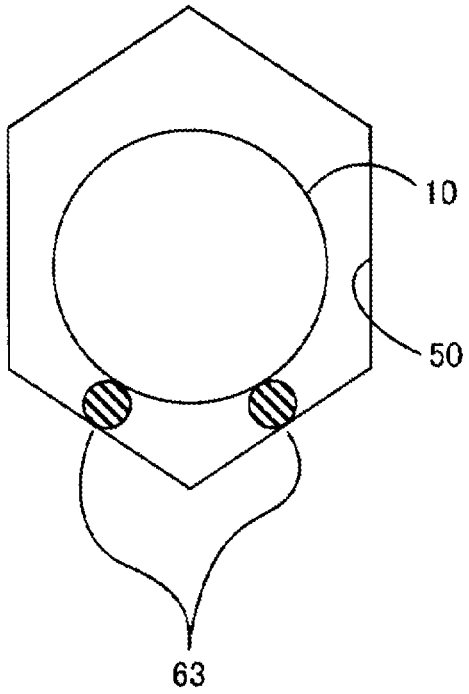
FIG. 9 is a schematic view showing a state of the first support point where the barrel supporting member and the barrel are in contact with each other.

FIG. 7 is a schematic view of the barrel supporting member and the barrel of a variation example. FIG. 8 is a schematic view showing a state of the second support point where the barrel supporting member and the barrel are in contact with each other. FIG. 9 is a schematic view showing a state of the first support point where the barrel supporting member and the barrel are in contact with each other.

In this variation example, instead of the rings 61, 62 which are the separate member, bearings 63, 64 having similar function are attached. Although two steel balls are illustrated as the bearings 63, 64 in the figures, the figures merely show the bearings 63, 64 as a model. The bearings 63, 64 can be anything as long as the barrel 10 and the barrel supporting member 50 are in contact with each other with low friction via the steel balls. For example, the steel balls can be supported by a guide member having an inner surface formed in a hexagonal shape so that each one of the steel balls is in contact with each inner surface of the guide member. Alternatively, concave portions can be formed on the outer surface of the barrel 10 to support the steel balls, or concave portions can be formed on the inner surface of the barrel supporting member 50 to support the steel balls.

Since the barrel 10 and the barrel supporting member 50 are in contact with each other with low friction via the bearings, the barrel 10 is moved smoothly. Since the movement is smooth, misalignment of the barrel 10 and misalignment of the trajectory of the bullet can be prevented.

The contact point between the bearing 63 and the barrel supporting member 50 corresponds to the first support point. The contact point between the bearing 64 and the barrel supporting member 50 corresponds to the first support point.

Figure 10:
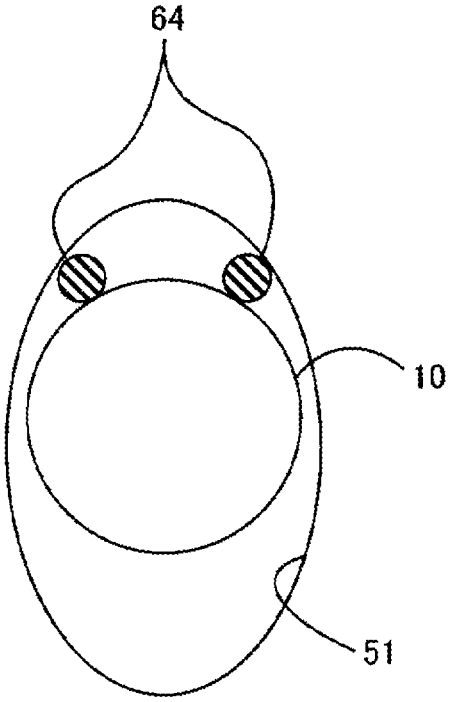
FIG. 10 is a schematic view showing a state of the second support point of the barrel supporting member and the barrel of a variation example.
Figure 11:
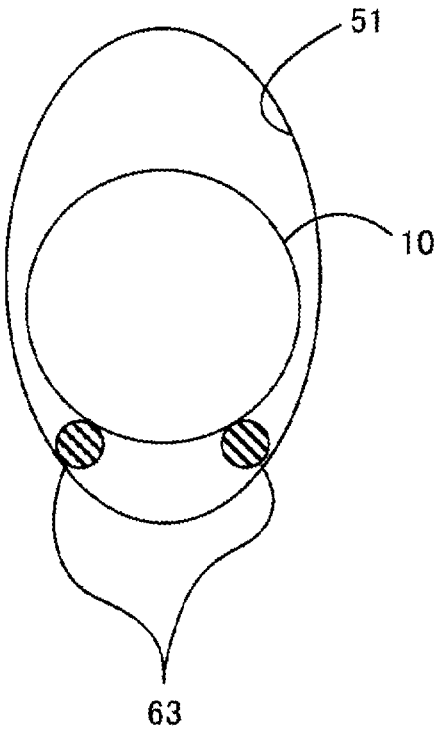
FIG. 11 is a schematic view showing a state of the first support point of the barrel supporting member and the barrel of a variation example.

FIG. 10 is a schematic view showing a state of the second support point of the barrel supporting member and the barrel of a variation example. FIG. 11 is a schematic view showing a state of the first support point of the barrel supporting member and the barrel of the same variation example.

In this variation example, instead of the barrel supporting member 50 having an inner surface formed in a hexagonal shape, a barrel supporting member 51 having an inner surface formed in an elliptical shape in cross-section is used. A long diameter direction of the elliptical shape is matched with a vertical direction.

Since the long diameter direction of the elliptical shape is matched with the vertical direction, the bearing 63, which corresponds to the first support point, is in contact with the inner surface of the barrel supporting member 51 at the lowest portion. The bearing 64, which corresponds to the second support point, is in contact with the inner surface of the barrel supporting member 51 at the highest position. Since the barrel 10 can be positioned at the center also in the right and left direction in addition to the lateral direction, the trajectory of the bullet can be prevented from being misaligned laterally and right and left with respect to the barrel supporting member 51. Note that the rings 61, 62 can be used instead of the bearings 63, 64.

Similarly, FIGS. 12 to 17 correspond to variation examples of the cross-sectional shape instead of the barrel supporting member 50 having an inner surface formed in a hexagonal shape.

Figure 12:
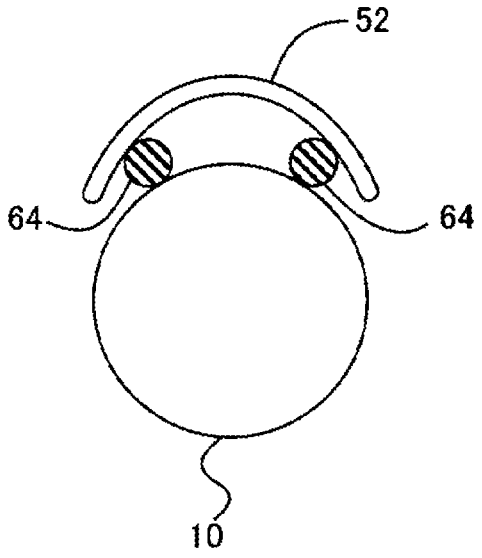
FIG. 12 is a schematic view showing a state of the second support point of the barrel supporting member and the barrel of a variation example.
Figure 13:
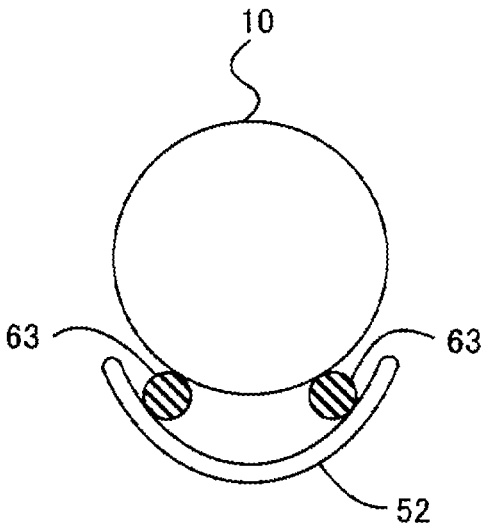
FIG. 13 is a schematic view showing a state of the first support point of the barrel supporting member and the barrel of a variation example.

FIG. 12 is a schematic view showing a state of the second support point of the barrel supporting member and the barrel of a variation example. FIG. 13 is a schematic view showing a state of the first support point of the barrel supporting member and the barrel of the same variation example.

In FIG. 12 and FIG. 13, a barrel supporting member 52 is not formed in a cylindrical shape completely. A semi-elliptical shape is formed on at least at the portion contacted with the bearing 63 and the portion contacted with the bearing 64. Other portions can be formed in a cylindrical shape or can be formed by extending the semi-elliptical shape.

Figure 14:
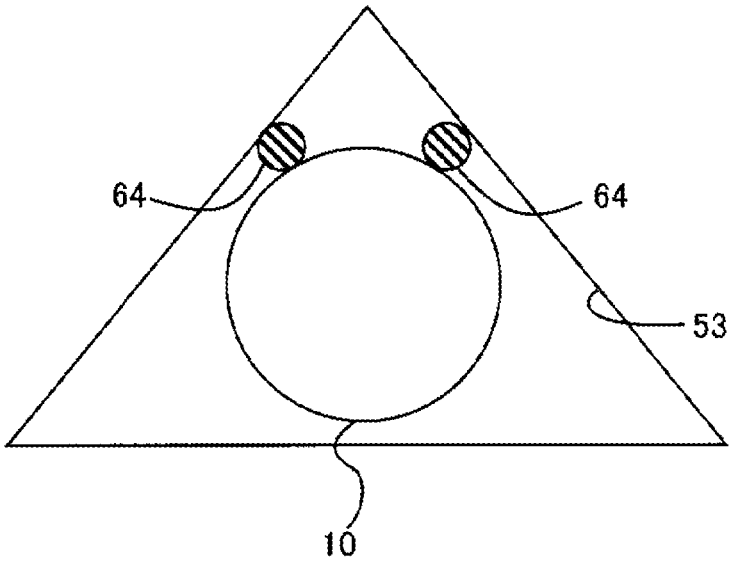
FIG. 14 is a schematic view showing a state of the second support point of the barrel supporting member and the barrel of a variation example.
Figure 15:
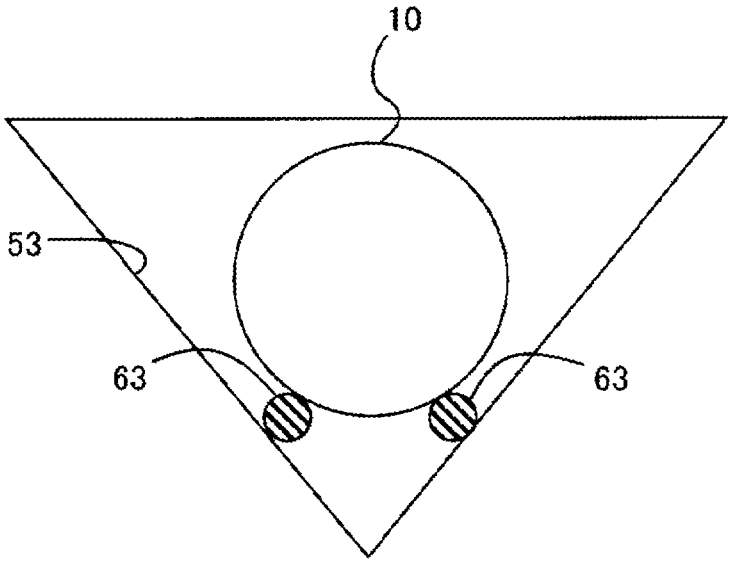
FIG. 15 is a schematic view showing a state of the first support point of the barrel supporting member and the barrel of a variation example.

FIG. 14 is a schematic view showing a state of the second support point of the barrel supporting member and the barrel of another variation example. FIG. 15 is a schematic view showing a state of the first support point of the barrel supporting member and the barrel of the same variation example.

In FIG. 14 and FIG. 15, a barrel supporting member 53 is formed in a triangular shape in cross-section. Further, the barrel supporting member 53 is formed in an inverse triangular shape in cross-section at a portion contacted with the bearing 63 so that an apex angle is located below, and formed in a triangular shape in cross-section at a portion contacted with the bearing 64 so that the apex angle is located above. The cross-sectional shape of the other portions can be formed in a circular shape or a semi-elliptical shape.

Figure 16:
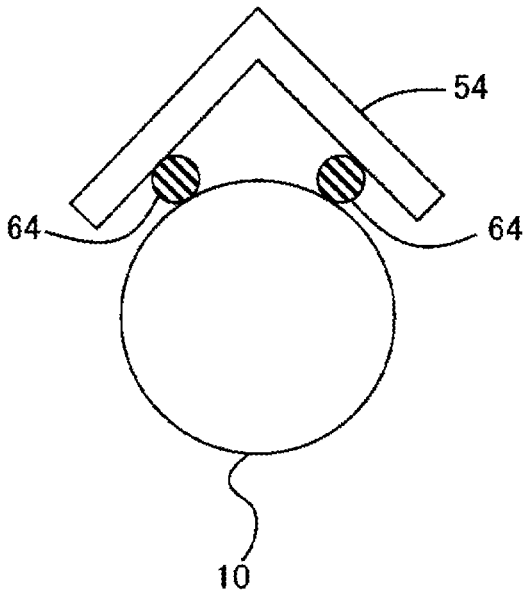
FIG. 16 is a schematic view showing a state of the second support point of the barrel supporting member and the barrel of a variation example.
Figure 17:
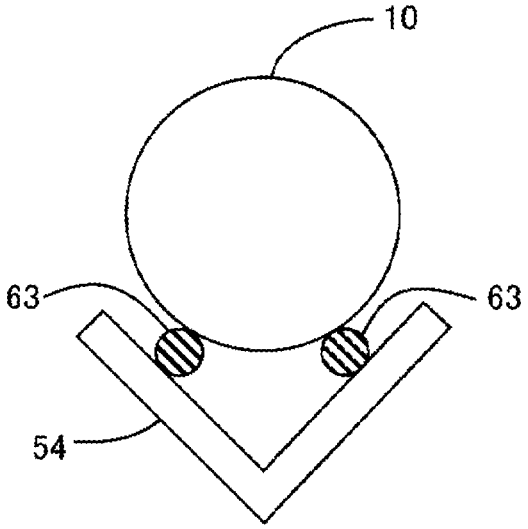
FIG. 17 is a schematic view showing a state of the first support point of the barrel supporting member and the barrel of a variation example.

FIG. 16 is a schematic view showing a state of the second support point of the barrel supporting member and the barrel of another variation example. FIG. 17 is a schematic view showing a state of the first support point of the barrel supporting member and the barrel of the same variation example.

In FIG. 16 and FIG. 17, although a barrel supporting member 54 is formed in a triangular shape, only a bottom surface having a V-shape and a ceiling surface having a reverse V-shape are mainly formed. This shape is defined as a semi-triangular shape, similar to the semi-elliptical shape. The barrel supporting member 54 forms a bottom surface having a V-shape at a portion contacted with the bearing 63, and a ceiling surface having a reverse V-shape at a portion contacted with the bearing 64. The cross-sectional shape of the other portions can be formed in a circular shape, a semi-elliptical shape or a triangular shape.

In all variation examples described above, the barrel 10 is prevented from being misaligned laterally and right and left with respect to the barrel supporting members 52 to 54. Thus, the trajectory of the bullet can be always kept constant.

Figure 18:
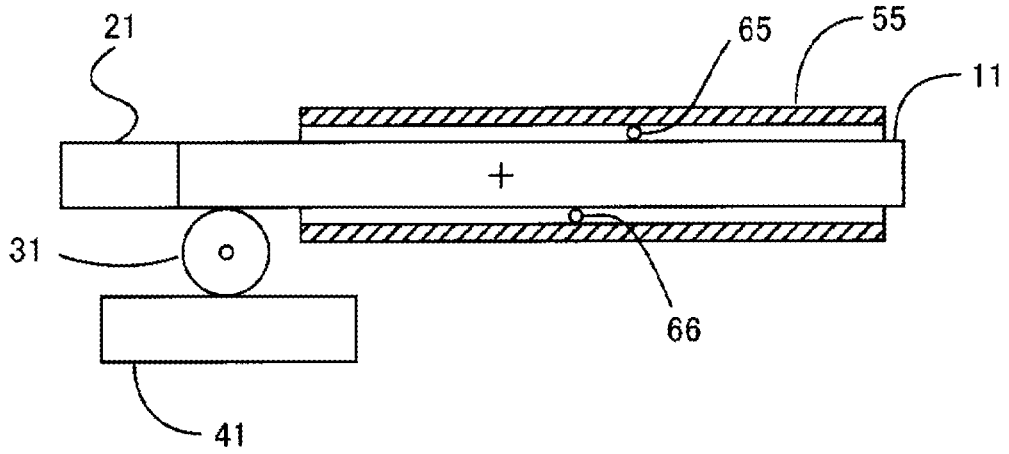
FIG. 18 is a schematic view showing a configuration of the low recoil firearm of a variation example.

FIG. 18 is a schematic view showing a configuration of the low recoil firearm of a variation example.

In this embodiment, a counterweight 41 is located below a barrel 11. A bolt 21 is arranged at the rear side of the barrel 11. The barrel 11 is engaged with and connected to the counterweight 41 via a gear 31.

Rings 65, 66, which are the supporting portions, are located further from the counterweight 41 than a gravity center of the barrel 11.

Here, the ring 65 is located at an opposite side of a relative position of the counterweight 41 with respect to the barrel 11. The ring 65 forms the first support point which is protruded so that a barrel supporting member 55 and the barrel 11 are in contact with each other. In addition, the ring 66 is located at a position nearer to a connection point between the barrel 11 and the counterweight 41 than the first support point. The ring 66 forms the second support point which is protruded so that the barrel supporting member 55 and the barrel 11 are in contact with each other at the position nearer to the connection point.

The rings 65, 66 are located at the front end side than the gravity center of the barrel 11 and the barrel 11 receives gravity to be rotated counterclockwise. However, since the ring 65 is located at the front end side than the ring 66, the barrel 11 is in contact with the upper surface of the inner surface of the barrel supporting member 55 via the ring 65 and the barrel 11 is in contact with the lower surface of the inner surface of the barrel supporting member 55 via the ring 66. Although the barrel 11 is rotated clockwise by an amount of the clearance when a force is intentionally applied, the barrel is not rotated counterclockwise.

Since the barrel 11 is located upper than the counterweight 41 and engaged with the upper surface side of the gear 31, when the bullet is shot and the barrel 11 is moved backward, a force to rotate the barrel 11 itself counterclockwise is imparted by a circular surface shape of the gear 31. Namely, a backward force is imparted to the barrel 11. However, the barrel 11 receives a force to be rotated counterclockwise from the gravity center position, the ring 65 and the ring 66, and the barrel 11 is in contact with the inner surface of the barrel supporting member 55. Thus, in spite of the existence of the clearance, the barrel 11 is not displaced in the barrel supporting member 55. In addition, the inclination angle of the barrel 11 is not inclined with respect to the horizontal direction.

Also in this example, the rings 65, 66, which correspond to the protruded support portions, are in contact with the inner surface of the V-shape and the reverse V-shape of the barrel supporting member 55 so that they are in contact with the inner surface at two points in a direction orthogonal to the longitudinal direction of the barrel 11. Accordingly, the barrel 11 is not displaced or rotated in a horizontal plane.

As explained above, when the counterweight 41 is located below the barrel 11 and the rings 65, 66, which are support portions, are located further from the counterweight than a gravity center of the barrel 11, the misalignment of the trajectory of the bullet can be prevented when the bullet is shot.

In the example shown in FIG. 18, the gravity center of the barrel 11 is located near to the counterweight 41 than the rings 65, 66 and the barrel 11 is preliminarily in contact with the barrel supporting member 55 counterclockwise by using a force to be rotated backward.

Figure 19:
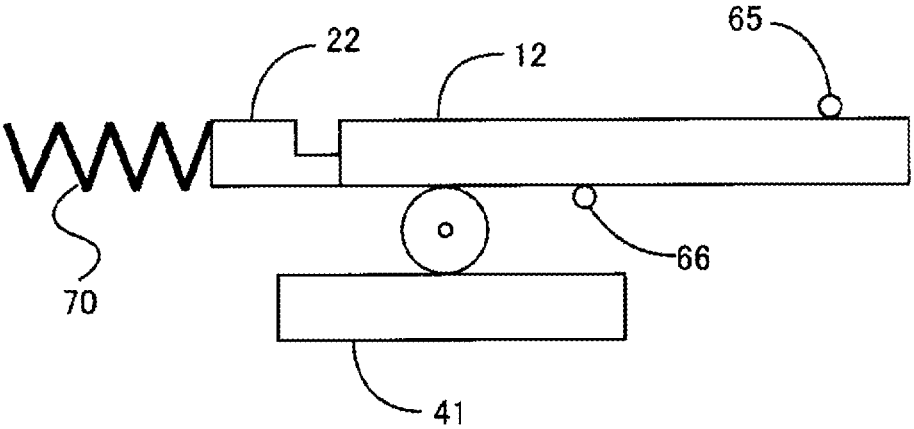
FIG. 19 is a schematic view showing a configuration of the low recoil firearm of a variation example.

FIG. 19 is a schematic view showing a configuration of the low recoil firearm of a variation example. In this embodiment, regardless of the position of the gravity center, a recoil spring 70 pushes a bolt 22 forward and the bolt 22 is in contact with the lower side of a barrel 12. Namely, a position offset to the lower side with respect to a gravity center in a vertical direction of the barrel 12 is pushed forward. Because of this offset, the barrel 12 receives a force to be rotated counterclockwise. Accordingly, same as the example shown in FIG. 18, when the counterweight 41 is located below the barrel 12, the misalignment of the trajectory of the bullet can be prevented when the bullet is shot.

As explained above, when the bolt 22 is pushed to the barrel 12 by the recoil spring 70 and the contact position of the bolt 22 and the barrel 12 is shifted below, a rotational driving force can be applied to the barrel 12 counterclockwise. Similarly, when the contact position of the bolt 22 and the barrel 12 is shifted above, the rotational driving force is applied the barrel 12 clockwise.

Figure 20:
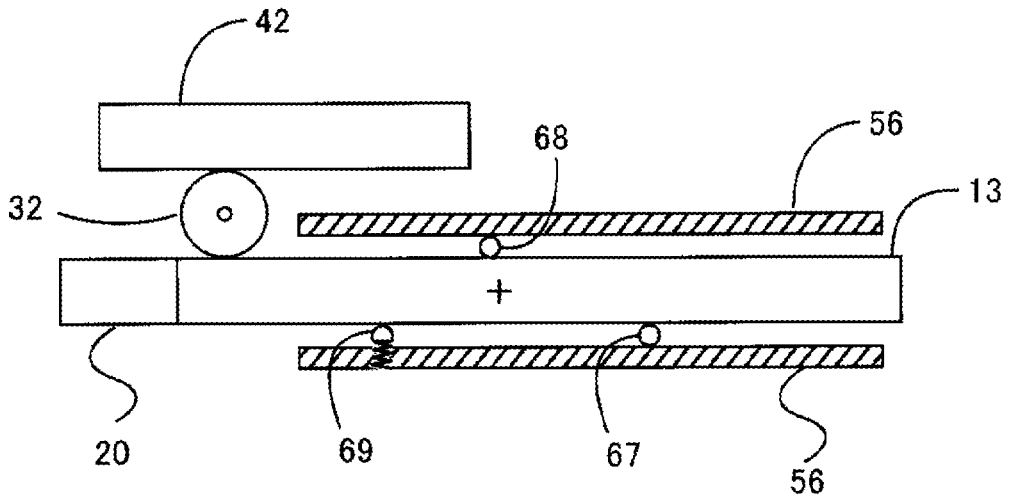
FIG. 20 is a schematic view showing a configuration of a main part of the low recoil firearm of a variation example.

FIG. 20 is a schematic view showing a configuration of a main part of the low recoil firearm of a variation example.

In this embodiment, regardless of the position of the gravity center, a plunger 69 is arranged on the first support point side. When a ring 67, which forms the first support point, is located at the further from a gear 32 and a ring 68, which forms the second support point, is located at the nearer to the gear 32, a barrel 13 may rotate counterclockwise depending on the position of the gravity center. Thus, there is a possibility that the barrel 13 is misaligned in the barrel supporting member.

However, the plunger 69 is arranged nearer to the gear 32 than the second support point and at an opposite side of a counterweight 42 with respect to the barrel 13 same as the first support point. Thus, the barrel 13 is pushed to the second support point side by the plunger 69. Because of this, the barrel 13 is always held at a position to be pushed to a barrel supporting member 56 by the rings 67, 68. Accordingly, same as the above described other examples, the misalignment of the trajectory of the bullet can be prevented when the bullet is shot.

As explained above, the barrel 13 is biased by the plunger 69, and the barrel 13 is pushed to the barrel supporting member 56 by the rings 67, 68, which are protruded support portions. In addition, the barrel 13 can be pushed to the barrel supporting member 56 by an attraction force of magnets using the rings 67, 68, which are protruded support portions.

Figure 21:
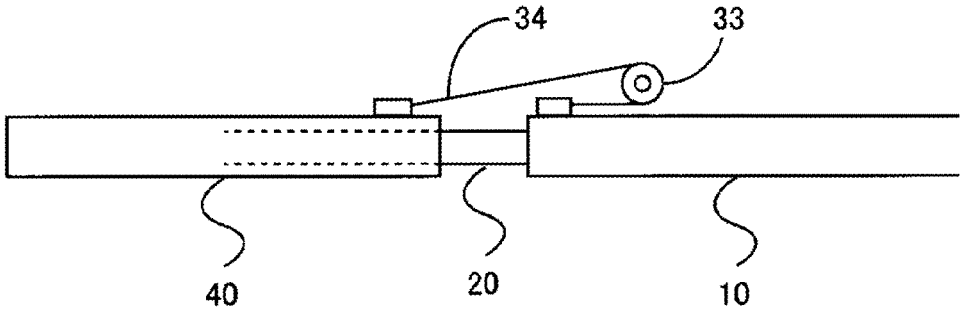
FIG. 21 is a drawing showing a variation example of an arrangement of a counterweight.

FIG. 21 is a drawing showing a variation example of an arrangement of a counterweight.

In the figure, the counterweight 40 is arranged on the same height as the barrel 10 and the bolt 20. In other words, they are horizontally arranged. In this example, the connecting member is formed by a pulley 33 and a belt 34. As explained above, the counterweight 40 is not necessarily arranged on the upper side or the lower side of the barrel 10 and the bolt 20.

In the above explanations, the chamber member is explained by the barrel 10 which is one separate member. However, in order to prevent the misalignment of the chamber member when the bullet is shot, the chamber member is not necessarily formed by one separate member. The chamber connecting member can be connected integrally with the chamber.

Figure 22:
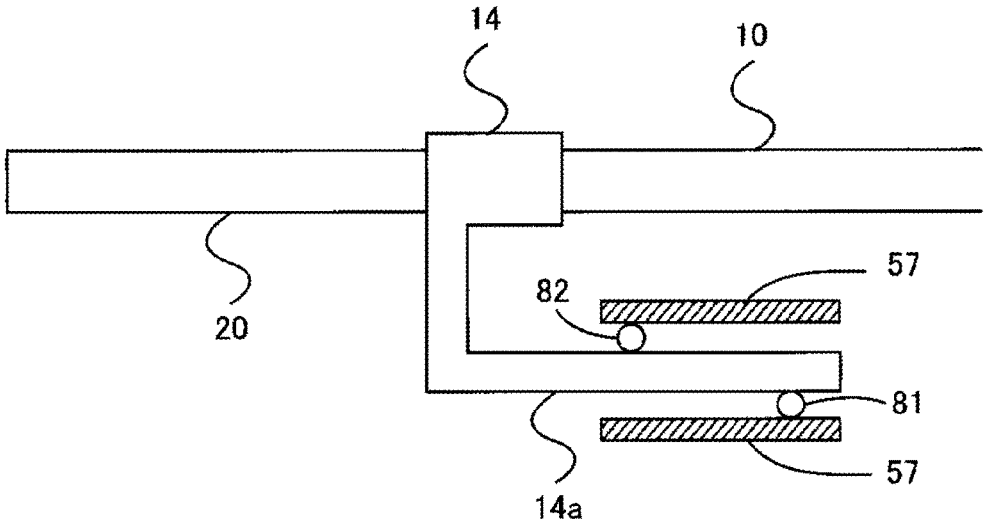
FIG. 22 is a drawing showing a variation example of a chamber member.

FIG. 22 is a drawing showing a variation example of the chamber member.

In this example, although the barrel 10 and a chamber connecting member 14 are separate members, they are integrally and fixedly connected. The chamber connecting member 14 is integrally and fixedly connected to the rear end portion of the barrel 10. The chamber connecting member 14 has a guide portion 14*a* which is protruded below from the rear end of the barrel 10 and bent toward the front end side of the barrel 10. The guide portion 14*a* is inserted into a tubular chamber member supporting member 57, which corresponds to the barrel supporting member 50. Same as the barrel 10, the guide portion 14*a* is movable back and forth in an axial center direction in the chamber member supporting member 57. Protruded members 81, 82, which correspond to the rings 61, 62, are attached to the guide portion 14*a*, and the guide portion 14*a* is in contact with the inner surface of the chamber member supporting member 57 at two different points in the longitudinal direction. Namely, these contact points correspond to the protruded support portions.

Although the counterweight 40 is not illustrated in the figure, even when the barrel 10 is about to be tilted by the recoil of shooting, the guide portion 14*a* is in contact with the inner surface of the chamber member supporting member 57 by the protruded members 81, 82. Because of this positional relation, the tilt of the guide portion 14*a* and the barrel 10 can be prevented.

Furthermore, also in a rotary gun (hereafter, referred to merely as revolver), the tilt when shooting can be prevented and the misalignment of the trajectory of the bullet can be prevented.

Figure 23:
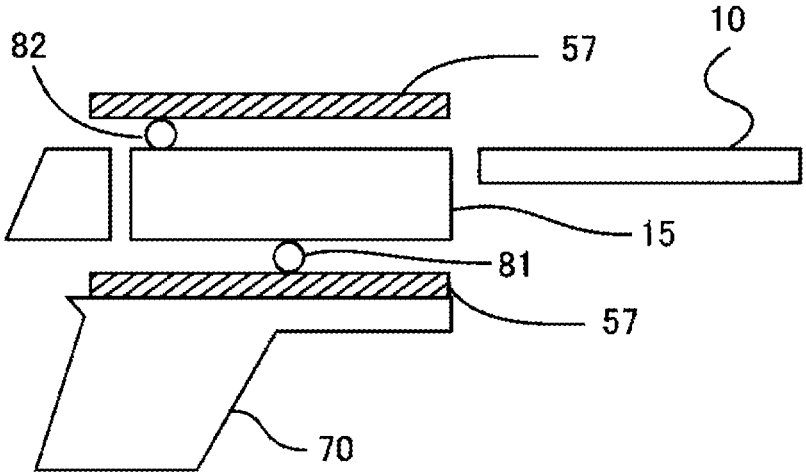
FIG. 23 is a drawing showing an approximate configuration of a rotary gun.
Figure 24:
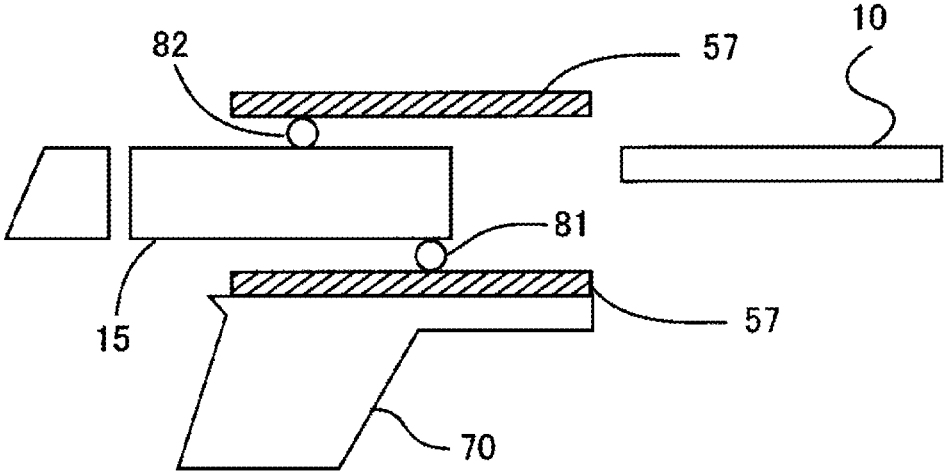
FIG. 24 is a drawing showing an approximate configuration of the rotary gun when a bullet is shot.
Figure 25:
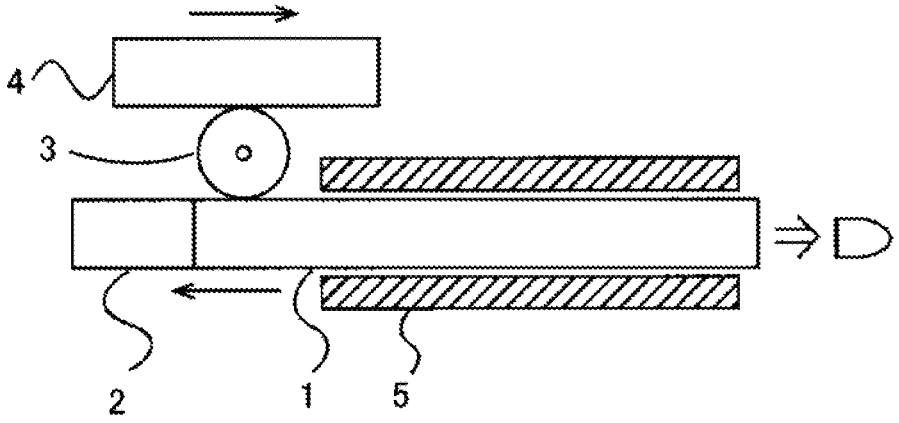
Prior Art Fig. 25
FIG. 25 is a schematic view showing a configuration of the low recoil firearm.
Figure 26:
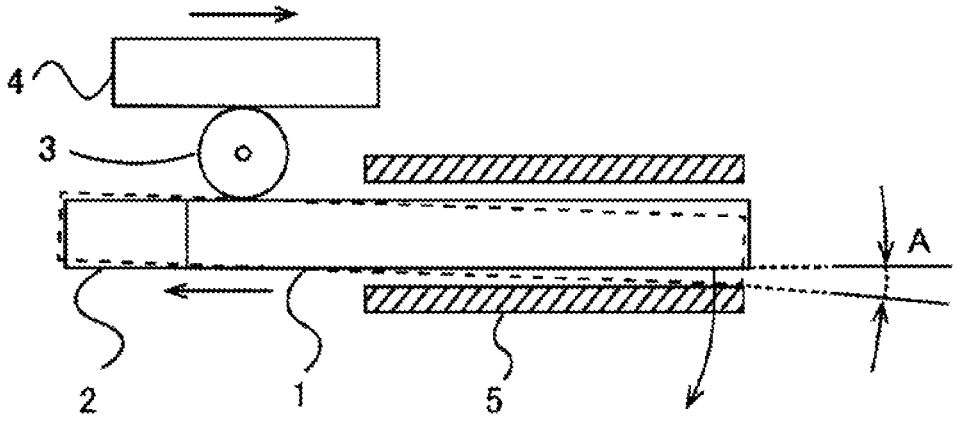
Prior Art Fig. 26
FIG. 26 is a schematic view showing a principle of misalignment of the trajectory of the bullet in the low recoil firearm.

FIG. 23 is a drawing showing an approximate configuration of a rotary gun. FIG. 24 is a drawing showing an approximate configuration of the rotary gun when a bullet is shot.

A rotating magazine 15 has a chamber. The rotating magazine 15 corresponds to the chamber member. The barrel 10 is not integrally formed with the rotating magazine 15. When shooting a bullet, the rotating magazine 15 is moved backward while driving a not illustrated counterweight in an opposite direction. A chamber member supporting member 57 is provided so that the rotating magazine 15 is inserted into the chamber member supporting member 57. Protruded portions 81, 82 are formed on the chamber member supporting member 57 side. The rotating magazine 15 and the chamber member supporting member 57 are in contact with each other at the protruded portions 81, 82 which are different two points in the longitudinal direction. Namely, these contact points correspond to the protruded support portions.

As explained above, even when the rotating magazine 15 is provided, the tilt when shooting can be prevented and the misalignment of the trajectory of the bullet can be prevented by forming the support portions at two different positions in the longitudinal direction.

Note that, this invention is not limited to the above-mentioned embodiments. Although it is to those skilled in the art, the following are disclosed as the one embodiment of this invention.

The low recoil firearm is not limited by a type of the firearm such as a gun and a rifle.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

What is claimed is:

1. A low recoil firearm, comprising:

a chamber member in which a chamber is formed, the chamber member being movable back and forth in an axial center direction;

a chamber member supporting member into which the chamber member is inserted so that the chamber member supporting member supports the chamber member to be movable back and forth in the axial center direction; and a counterweight connected to the chamber member, the counterweight being driven in a direction opposite to a movement of the chamber member when a bullet is shot, wherein protruded support portions are formed on the chamber member supporting member or the chamber member so that the chamber member supporting member and the chamber member are in contact with each other at a first support point from a lower side of the chamber member and in contact with each other at a second support point from an upper side of the chamber member, and the first support point and the second support point are located at a different position in a longitudinal direction of the chamber member.

2. The low recoil firearm according to claim 1, wherein the chamber member is a barrel, and the chamber member supporting member is a barrel supporting member.

3. The low recoil firearm according to claim 1, wherein the chamber member has a chamber connecting member which is integrally connected to the chamber, and the chamber connecting member is inserted into the chamber member supporting member so that the chamber member supporting member supports the chamber connecting member to be movable back and forth in the axial center direction.

4. The low recoil firearm according to claim 3, wherein the chamber connecting member has a member which transfers a movement of one of the chamber member and the counterweight to the other at surfaces facing each other while reversing the direction of the movement, the protruded support portions have:

a first support point which is protruded so that the chamber member supporting member and the chamber member are in contact with each other at an opposite side of a relative position of the counterweight with respect to the chamber member; and a second support point which is protruded so that the chamber member supporting member and the chamber member are in contact with each other at a position horizontally and vertically nearer to a connection point between the chamber member and the counterweight than the first support point.

5. The low recoil firearm according to claim 4, wherein the counterweight is located upper than the chamber member, and the protruded support portions are located nearer to the counterweight than a gravity center of the chamber member.

6. The low recoil firearm according to claim 4, wherein the counterweight is located lower than the chamber member, and the protruded support portions are located further from the counterweight than a gravity center of the chamber member.

7. The low recoil firearm according to claim 1, wherein the chamber member is a rotating magazine of a rotary gun, and the chamber member supporting member is a magazine supporting member which supports the rotating magazine to be movable back and forth in the axial center direction.

8. The low recoil firearm according to claim 1, wherein the protruded support portions are formed on an inner surface of the chamber member supporting member to be protruded toward the chamber member.

9. The low recoil firearm according to claim 1, wherein the protruded support portions are formed on the chamber member to be protruded toward an inner surface of the chamber member supporting member.

10. The low recoil firearm according to claim 1, wherein the protruded support portions are formed by arranging a separate member between the chamber member supporting member and the chamber member.

11. The low recoil firearm according to claim 10, wherein the separate member is a bearing.

12. The low recoil firearm according to claim 1, wherein the protruded support portions are formed at two points in a direction orthogonal to the longitudinal direction of the chamber member.

13. The low recoil firearm according to claim 1, wherein an inner surface of the chamber member supporting member has a hexagonal shape in cross-section.

14. The low recoil firearm according to claim 1, wherein an inner surface of the chamber member supporting member has an elliptical shape in cross-section.

15. The low recoil firearm according to claim 1, wherein an inner surface of the chamber member supporting member has a semi-elliptical shape in cross-section.

16. The low recoil firearm according to claim 1, wherein an inner surface of the chamber member supporting member has a triangular shape in cross-section.

17. The low recoil firearm according to claim 1, wherein an inner surface of the chamber member supporting member has a semi-triangular shape in cross-section.

18. The low recoil firearm according to claim 1, wherein a bolt is pressed to the chamber member by a recoil spring so that a rotational driving force is applied to the chamber member clockwise or counterclockwise by laterally displacing a contact position of the bolt and the chamber member.

19. The low recoil firearm according to claim 1, wherein a first clearance exists between the barrel and the barrel supporting member on the upper side of the chamber member at the first support point, and a second clearance exists between the barrel and the barrel supporting member on the lower side of the chamber member at the second support point.

20. The low recoil firearm according to claim 1, wherein the protruded support portions have a ring shape.

* * * * *